US011692247B2

(12) United States Patent
Park et al.

(10) Patent No.: US 11,692,247 B2
(45) Date of Patent: Jul. 4, 2023

(54) WROUGHT MAGNESIUM ALLOY HAVING IMPROVED PROPERTIES, METHOD OF MANUFACTURING SAME, AND HIGH-SPEED EXTRUSION METHOD USING SAME

(71) Applicant: Kyungpook National University Industry-Academic Cooperation Foundation, Daegu (KR)

(72) Inventors: Sung Hyuk Park, Daegu (KR); Jong Bin Go, Daegu (KR); Sang Cheol Jin, Busan (KR)

(73) Assignee: Kyungpook National University Industry-Academic Cooperation Foundation, Daegu (KR)

( * ) Notice: Subject to any disclaimer, the term of this patent is extended or adjusted under 35 U.S.C. 154(b) by 52 days.

(21) Appl. No.: 17/215,605

(22) Filed: Mar. 29, 2021

(65) Prior Publication Data

US 2021/0301373 A1 Sep. 30, 2021

(30) Foreign Application Priority Data

Mar. 30, 2020 (KR) ..... 10-2020-0038380
Mar. 30, 2020 (KR) ..... 10-2020-0038381

(51) Int. Cl.
*C22C 23/02* (2006.01)
*B22D 21/04* (2006.01)
(Continued)

(52) U.S. Cl.
CPC ..... *C22C 23/02* (2013.01); *B21C 23/01* (2013.01); *B22D 21/04* (2013.01); *C21D 9/0081* (2013.01)

(58) Field of Classification Search
None
See application file for complete search history.

(56) References Cited

FOREIGN PATENT DOCUMENTS

CN 105154734 A * 12/2015
CN 108220725 A * 6/2018 ..... B21B 27/024
(Continued)

OTHER PUBLICATIONS

English language machine translation of CN-109338187-A. Generated Nov. 3, 2022. (Year: 2022).*
(Continued)

*Primary Examiner* — Brian D Walck
(74) *Attorney, Agent, or Firm* — Knobbe Martens Olson & Bear LLP

(57) ABSTRACT

This application relates to a wrought magnesium alloy and a method of manufacturing the same, and a high-speed extrusion method for manufacturing an extrudate using the same. In one aspect, the magnesium alloy includes 2.0 wt % to 8.0 wt % of bismuth (Bi), 0.5 wt % to 6.5 wt % aluminum (Al), the balance of magnesium (Mg), and inevitable impurities. Using a magnesium alloy for high-speed extrusion according to the present disclosure, it is possible to manufacture a magnesium alloy extrudate having a good surface quality without hot cracking even under high-temperature (extrusion temperature: 300° C. to 450° C.) and high-speed (die-exit speed: 40 m/min to 80 m/min) extrusion conditions. Furthermore, the extrudate manufactured from the magnesium alloy exhibits greatly improved strength and elongation compared to existing magnesium extrudates even when the alloy does not contain a rare-earth metal.

13 Claims, 9 Drawing Sheets

(51) Int. Cl.
*B21C 23/01* (2006.01)
*C21D 9/00* (2006.01)

(56) References Cited

FOREIGN PATENT DOCUMENTS

| | | | | | | |
|---|---|---|---|---|---|---|
| CN | 109182809 | A | * | 1/2019 | ..... | C22C 1/03 |
| CN | 109266932 | A | * | 1/2019 | ..... | C22C 1/03 |
| CN | 109338187 | A | * | 2/2019 | ..... | C22C 1/03 |
| KR | 10-0994812 | B1 | | 11/2010 | | |
| KR | 10-2012-0095184 | A | | 8/2012 | | |
| KR | 10-1406111 | B1 | | 6/2014 | | |

OTHER PUBLICATIONS

English language machine translation of CN-109182809-A. Generated Nov. 3, 2022. (Year: 2022).*
English language machine translation of CN-105154734-A. Generated Nov. 3, 2022. (Year: 2022).*
Go et al. "Significant improvement in the mechanical properties of an extruded Mg—5Bi alloy through the addition of AI." Journal of Alloys and Compounds 821 (2020). pp. 1-12. Available online Dec. 19, 2019. (Year: 2019).*
English language machine translation of CN-109266932-A. Generated Mar. 31, 2023. (Year: 2023).*
English language machine translation of CN-108220725-A. Generated Mar. 31, 2023. (Year: 2023).*
Bettles et al., "Current Wrought Magnesium Alloys: Strengths and Weaknesses", *JOM*, May 2005, pp. 46-49.
Friedrich et al., *Magnesium Technology: Metallurgy, Design Data, Applications*, ISBN-10 3-540-20599-3, Springer-Verlag Berlin Heidelberg 2006.
Park et al., "Microstructural evolution of indirect-extruded ZK60 alloy by adding Ce", *Journal of Alloys and Compounds*, vol. 545, 2012, pp. 139-143.
Zhang et al., "Effects of Ce addition on microstructure and mechanical properties of Mg—6Zn—1Mn alloy", *Trans. Nonferrous Met. Soc. China*, vol. 21, 2011, pp. 703-710.

* cited by examiner

| | AZ80 commercial magnesium | | BA53 developed magnesium | |
|---|---|---|---|---|
| Extrusion speed | Comparative Example 2-1 | 4.5 m/min: Surface cracking | Example 2-1 | 60 m/min: No cracking |
| | Comparative Example 2-2 | 6.0 m/min: Surface cracking | Example 2-2 | 70 m/min: No cracking |

WROUGHT MAGNESIUM ALLOY HAVING IMPROVED PROPERTIES, METHOD OF MANUFACTURING SAME, AND HIGH-SPEED EXTRUSION METHOD USING SAME

CROSS REFERENCE TO RELATED APPLICATION

The present application claims priority based on Korean Patent Application Nos. 10-2020-0038380 and 10-2020-0038381, filed on Mar. 30, 2020, the entire contents of which are incorporated. herein for all purposes by this reference.

BACKGROUND

Technical Field

The present disclosure relates to a wrought magnesium alloy and a method of manufacturing the same, and to a magnesium alloy having improved properties, obtained using a novel composition in order to overcome poor mechanical properties, which are a disadvantage of a conventional commercial magnesium extrudate, and a high-speed extrusion method for manufacturing an extrudate using the same.

Description of the Related Technology

As international environmental regulations are becoming increasingly strict, lightweight vehicles characterized by low carbon dioxide emissions and excellent fuel efficiency have become the main focus of the automobile industry.

Accordingly, a magnesium alloy based on magnesium, having very low density (Mg: 1.738 g/cm$^3$, Fe: 7.874 g/cm$^3$, Ti: 4.506 g/cm$^3$ and Al: 2.70 g/cm$^3$) compared to other structural metallic materials, have been attracting great attention in the transportation. industry as a material for reducing the weight of vehicles.

Previous studies on magnesium alloys have mainly focused on casting magnesium alloys for application to automobile engines or gear bracket components based on the good castability of but cast magnesium alloy products frequently have casting defects, which results in the deterioration of mechanical properties. Therefore, to obtain superior mechanical properties, studies on wrought magnesium alloys that are subjected to metal forming processes such as extrusion, rolling, and forging have been actively conducted.

In particular, a magnesium alloy extrudate exhibits mechanical properties superior to those of a magnesium alloy cast product, and therefore, it is suitable for use in automobile body and chassis components such as bumper beams, radiator supports, engine cradles, and subframes.

However, since the magnesium alloy extrudate has lower strength and a higher price than aluminum alloy extruitates, their widespreadapplication to the automobile industry and other industries remains difficult.

Meanwhile, when manufacturing a magnesium alloy extrudate, the extrusion speed is directly related to the unit cost of the final product, so increasing the available maximum extrusion speed of an alloy is very important for commercialization of the alloy.

For AZ31, which is currently the most widely used magnesium alloy, it is known that almost no secondary phase is formed during extrusion due to the low total alloying content, about 4.0 wt %, and thus the maximum extrusion speed is relatively high, about 30 m/min, but a AZ31 extrudate has low strength because of no particie-induced strengthening effect.

On the other hand, highly alloyed commercial magnesium alloys such as AZ80, AZ91, and ZK60 have high strength, but they have poor extrudability with a maximum extrusion speed of 0.5-4.0 m/min, which is considerably lower than the maximum extrusion speed of commercial aluminum alloys for extrusion (about 40 m/min or more). The low extrudability acts as a major cause of increased unit cost of the magnesium extrudate due to the decreased productivity, which is ultimately considered as the main factor deteriorating the market competitiveness of the magnesium extrudate.

The reason why it is difficult to extrude commercial magnesium alloys at a high speed is that the surface temperature of the material rses due to the processing heat generated during extrusion, and thus secondary phases such as $Mg_{17}Al_{12}$, $MgZn_2$, and the like, which have a low melting point of 450° C. or lower, are partially melted, resulting in hot cracking.

In order to solve this problem and improve extrudability, research on an alloy system capable of preventing formation of a thermally unstable secondary phase by reducing the content or forming a thermally stable secondary phase has been conducted.

For example, Mg—Al or Mg—Zn magnesium alloys a low total alloying content of 1.5 wt % or less, which capable of manufacturing an extrudate at a high speed of 60 m/min by preventing the formation of a secondary phase during extrusion, have been suggested, but there is a problem in that the manufactured extrudate has very low mechanical strength due to the lack of precipitation strengthening and solid-solution strengthening effects.

In addition, highly alloyed magnesium alloys such as Mg—8Sn—1Al—1Zn (wt %) or the like, capable of manufacturing an extrudate without hot cracking even at an extrusion speed of about 20 m/min by forming a thermally stable $Mg_2Sn$ phase during extrusion, have been. suggested, but the extrusio. speed thereof is still far below the maximum extrusion speed of commercial alumdnum alloys.

SUMMARY

Therefore, an objective of the present disclosure is to provide a novel magnesium alloy, which is capable of manufacturing a magnesium extrudate having significantly improved mechanical properties and also of manufacturing an extrudate with a good surface quality without hot cracking even at a high speed, and. a method of manufacturing a magnesium extrudate using the same.

In order to accomplish the above objective, an aspect of the present disclosure provides a magnesium alloy including 2.0 to 8.0 wt % of bismuth (Bi), 0.5 to 6.5 wt % of aluminum (Al) the balance of magnesium (Mg), and inevitable impurities.

Also, a rare--earth metal may not be contained as an alloying element.

In addition, the magnesium alloy, suitable for use as a magnesium alloy having improved mechanical properties for extrusion, may further include at least one alloying element, as necessary, in addition to bismuth (Bi) and aluminum (Al) , and examples of the additional alloying element may typically include tin (Sn), zinc (Zn), manganese (Mn), calcium (Ca), and the like.

In addition, as a magnesium alloy capable of manufacturing an extrudate having a good surface quality without hot cracking even upon high-speed extrusion, a magnesium alloy for high-speed extrusion including 3.0 to 7.0 wt % of bismuth (Bi), 1.0 to 5.0 wt. % aluminum (Al), the balance of magnesium (Mg), and inevitable impurities is provided.

Also, the magnesium alloy for high-speed extrusion may further include 0.1 to 1.0 wt % of at least one metal selected from the group consisting of calcium (Ca), manganese (Mn), and yttrium (Y) as an alloying element.

Another aspect of the present disclosure provides a method of manufacturing an extrudate from the magnesium alloy, including: (a) manufacturing a magnesium alloy billet by casting a melt of a magnesium alloy including 2.0 to 8.0 wt % of bismuth (Bi), 0.5 to 6.5 wt % of aluminum (Al), the balance of magnesium (Mg), and inevitable impurities; (b) subjecting the magnesium alloy billet manufactured in step (a) to homogenization heat treatment and cooling; and (C) extruding the magnesium alloy billet subjected to homogenization heat treatment in step (b).

Here, in step (a), the melt of the magnesium alloy including 2.0 to 8.0 wt % of bismuth (Bi), 0.5 to 6.5 wt % of aluminum (Al), the balance of magnesium (Mg), and inevitable impurities may be maintained at 670 to 770° C. for 20 minutes and then cast, thus manufacturing a magnesium alloy billet.

Also, in step (b), the magnesium alloy billet may be subjected to homogenization heat treatment at 350 to 550° C. for 0.5 to 72 hours, followed by water quenching.

Also, in step (c), the billet subjected to homogenization neat treatment may be preheated to 200 to 450° C. and then extruded.

Also, a secondary phase including $Mg_3Bi_2$ may be dynamcally precipitated during extrusion in step (c).

Also, in step (c), the magnesium alloy billet may be extruded using an indirect extrusion process, a direct extrusion process, a hydrostatic extrusion process, or an impact extrusion process.

In addition, the present disclosure provides a method of manufacturing an extricate from the magnesium alloy for high-speed extrusion, including: (a) preparing a magnesium alloy billet including 3.0 to 7.0 wt % of bismuth (Bi), 1.0 to 5.0 wt % of aluminum (Al) , the balance of magnesium (Mg), and inevitable impurities; (b) subjecting the magnesium alloy billet to homogenization heat treatment; and (c) extruding the magnesium alloy billet subjected to homogenization heat treatment under conditions of an extrusion temperature of 300 to 450° C. and a die-exit speed of 40 to 80 m/min.

Here, in step (b) , the magnesium alloy billet may be subjected to homogenization heat treatment at a temperature corresponding to a two-phase region α-Mg and. $Mg_3Bi_2$ in an Mg—Bi—Al ternary equilibrium phase diagram.

Also, the magnesium alloy billet may further include 0.1 to 1.0 wt % of at least one metal selected from the group consisting of calcium (Ca), manganese (Mn) , and yttrium (Y).

Still another aspect of the present disclosure provides a magnesium alloy extrudate manufactured using the method of manufacturing the extrudate described above.

Here, the magnesium. alloy extrudate may include $Mg_3Bi_2$ precipitated particles as a secondary phase.

Also, the magnesium alloy extrudate may include 3.0 to 7.0 wt % of bismuth (Bi), 2.0 to 6.0 wt. % aluminum (Al), the balance of magnesium (Mg), and inevitable impurities, in which the value of ultimate tensile strength (UTS)× elongation may be 4000 MPa·% or more.

Also, the magnesium alloy extrudate may include 5.0 wt % of bismuth (Bi), 6.0 wt % aluminum (Al), the balance of magnesium (Mg), and inevitable impurities, which the value of ultimate tensile strength (UTS)×elongation may be 5792 MPa·%.

According to the present disclosure, a magnesium alloy is configured such that a Mg—Bi. binary alloy is further added with aluminum (Al), thus promoting dynamic recrystallization during extrusion, thereby forming a microstructure composed of uniform and fine grains and secondary phase ($Mg_3Bi_2$) particles that are precipitated during extrusion, ultimately exhibiting greatly improved strength and elongation compared to existing magnesium extrudates even in the absence of a rare-earth metal as an alloying element.

In addition, when manufacturing an extrudate using a magnesium alloy for high--speed extrusion according to the present disclosure, it is possible to produce a magnesium alloy extrudate having a good surface quality without hot cracking even under high-temperature (extrusion temperature: 300 to 450° C.) and high-speed (die-exit speed: 40 to 80 m/min) extrusion conditions, whereby the extrudate can be manufactured at a speed at least 10 times as fast as highly alloyed commercial magnesium alloys such as AZ80 (Mg-8Al-0.5Zn), AZ91 (Mg-9Al-1Zn), ZK60 (Mg-6Zn-0.5Zr) and the like. Thereby, the present disclosure can be very efficiently used for mass production of the magnesium alloy extrudate by greatly reducing manufacturing costs by virtue of the improved productivity.

DETAILED DESCRIPTION

Figure 1:
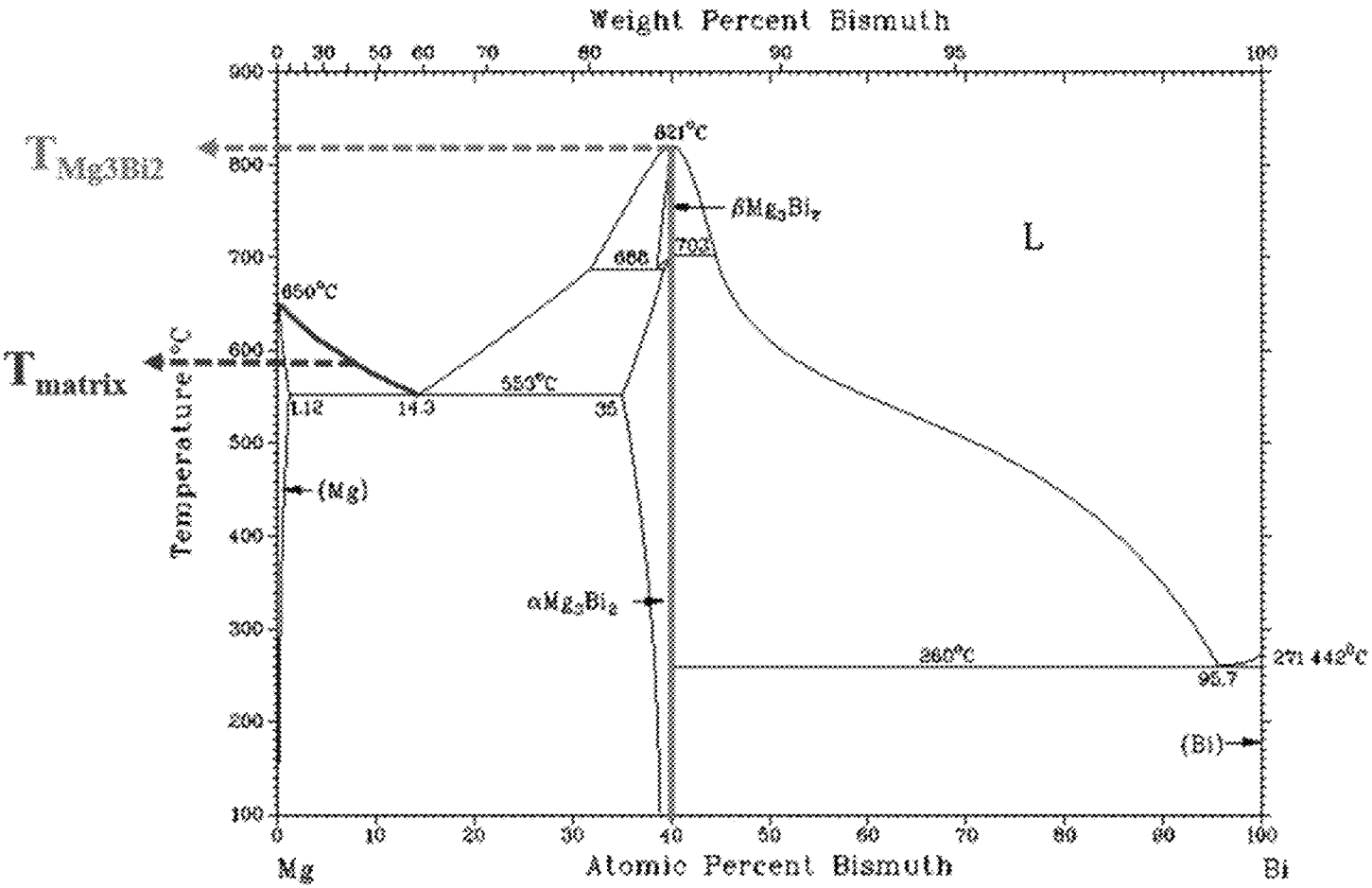
FIG. 1 shows an Mg—Bi binary equilibrium phase diagram.

In the following description of the present disclosure, detailed descriptions of known functions and components incorporated herein will be omitted when the same may make the subject matter of the present disclosure unclear.

Reference will now be made in detail to various embodiments of the present disclosure, specific examples of which are illustrated in the accompanying drawings and described below, since the embodiments of the present disclosure can be variously modified in many different forms. While the present disclosure will be described in conjunction with exemplary embodiments thereof, it is to be understood that the present description is not intended to limit the present disclosure to those exemplary embodiments. On the contrary, the present disclosure is intended to cover not only the exemplary embodiments, but also various alternatives, modifications, equivalents and. other embodiments that may be included within the spirit and scope of the present disclosure as defined by the appended clams.

The terminology used herein is for the purpose of describing particular embodiments only and is not intended to be limiting. As used herein, the sinquar forms are intended to include the plural forms as well, unless the context clearly indicates otherwise. It will be further understood that the terms "comprise", "include", "have", etc., when used in this specification, specify the presence of stated features, integers, steps, operations, elements, components, and/or combinations thereof but do not preclude the presence or addition of one or more other features, integers, steps, operations, elements, components, and/or combinations thereof.

Hereinafter, a detailed description will be given of the present disclosure.

A magnesium alloy for extrusion having superior mechanical properties according to the present disclosure includes 2.0 to 8.0 wt % of bismuth (Bi) , 0.5 to 6.5 wt % of aluminum (Al), the balance of magnesium (Mg), and inevitable impurities.

The reasons for limiting the alloy composition as described above in the magnesium alloy according to the present disclosure are as follows.

Bismuth (Bi)

Bismuth (Bi) may be added to the magnesium alloy to exhibit conditions favorable for high-temperature extrusion and precipitation strengthening. The maximum solid--solution limit of Bi in magnesium is high, namely 9 wt %, at 551° C., and a $Mg_3Bi_2$ secondary phase formed by the addition of Bi has a very high melting point of 823° C. and is thus stable at a high temperature, thereby improving the mechanical properties of the final extrudate.

If the amount of bismuth contained in the magnesium alloy extrudate according to the present disclosure is less than 2.0 wt %, the precipitation-strengthening effect after extrusion cannot be effectively exhibited due to the lack of the amount of Bi solute atoms, and thus the strength of the final extrudate is low. On the other hand, if the amount thereof exceeds 8.0 wt %, the coarse $Mg_3Bi_2$ dispersed phase remaining after homogenization heat treatment is left behind in the final extrudate, causing premature failure during tensile testing and eventually deteriorating the mechanical properties of the final extrudate.

Therefore, the magnesium alloy extrudate according to the present disclosure preferably includes 2.0 to 8.0 wt % o Bi.

Aluminum (Al)

Aluminum (Al) is an alloying element that is added to the Mg—Bi alloy to improve the mechanical properties of the magnesium alloy.

If the amount of aluminum contained in the magnesium alloy extrudate according to the present disclosure is less than 0.5 wt %, this amount is not sufficient to promote dynamic recrystallization during extrusion, and thus the size of grains after extrusion is not uniform, and it is difficult to expect the effect of increasing strength and ductility because of the coarse grains and nonuniform grain structure. On the other hand, if the amount thereof exceeds 6.5 wt %, the coarse $Mg_{17}Al_{12}$ phase formed in the solidification process during casting may not be completely dissolved in the magnesium matrix upon homogenization heat treatment but may remain in the final material after extrusion, and such a coarse phase may cause premature failure dur.ng tensile testing and eventually deteriorating the mechanical properties of the final extrudate.

Therefore, the magnesium alloy extrudate according to the present disclosure preferably includes 0.5 to 6.5 wt % of Al.

Other inevitable impurities

The magnesium extrudate according to the present disclosure may include impurities that are inevitably present in the raw materials of the alloy or are introduced in the manufacturing process, and among these impurities, Fe, Cu, and Ni are components that deteriorate the corrosion resistance of the magnesium alloy. Therefore, it is preferable to maintain 0.004 wt % or less of Fe, 0.005 wt % or less of Cu, and 0.001 wt % or less of Ni.

Moreover, the magnesium extrudate according to the present disclosure may further include at least one alloying element, as necessary, in addition to the aforementioned Bi and Al, and examples of the additional alloying element may typically include, but are not necessarily limited to, tin (Sn), zinc (Zn), manganese (Mn), calcium (Ca), and the like, as described below.

Tin (Sn)

Tin (Sn) has a maximum solid solubility of 14.5 wt % at 561° C. in magnesium, and when Sn is added in an amount of 1.0 wt % or more, a fine $Mg_2Sn$ precipitate phase is formed through heat treatment, thereby exhibiting an aging-hardening effect.

If the amount of Sn that is added to the magnesium alloy is less than 1.0 wt %, precipitation. strengthening cannot be expected, whereas if the amount thereof exceeds 3.0 wt %, the coarse $Mg_2Sn$ phase is excessively formed during casting, making it difficult to sufficiently remove the same through heat treatment, and moreover, a considerable amount of such coarse particles may remain even after extrusion, undesirably resulting in deteriorated mechanical properties of the final extrudate.

Therefore, when the magnesium alloy extrudate according to the present disclosure includes Sn, the amount of Sn preferably falls in the range of 1.0 to 3.0 wt %.

Zinc (Zn)

Like aluminum, zinc (Zn) contributes to increasing the strength of the magnesium alloy through solid-solution strengthening and precipitation strengthening.

If the amount of zinc that is added is less than 0.1 wt %, the effect of increasing the strength. cannot be expected, whereas if the amount thereof exceeds 3.5 wt %, micro-galvanic corrosion may be promoted, and thus the corrosion resistance of the extrudate may be deteriorated.

Therefore, when the magnesium alloy extrudate according to the present disclosure includes Zn, the amount of Zn preferably falls in the range of 0.1 to 3.5 wt %.

Manganese (Mn)

Manganese (Mn) contributes to increasing the strength of the alloy by causing solid-solution strengthening and/or forming various dispersed. particles through binding with aluminum (Al), and is also effective at increasing the corrosion resistance of the alloy.

If the amount of manganese (Mn) is added to magnesium alloy is less than 0.05 wt %, it is difficult to expect the effects described above, whereas if the amount thereof exceeds 1.5 wt %, coarse Mn-containing particles may be formed during the solidification process casting, undesirably resulting in deteriorated mechanical properties of the alloy.

Therefore, when the magnesium alloy extrudate according to the present disclosure includes Mn, the amount of Mn preferably falls in the range of 0.05 to 1.5 wt %.

Calcium (Ca)

Calcium (Ca) not only improves strength. and heat-resistance property by forming an Mg—Al—Ca intermetallic compound in the magnesium alloy containing aluminum, but also forms a thin and dense CaO oxide layer on the surface of the melt, thus inhibiting, oxidation of the melt, thereby improving the ignition resistance of the magnesium alloy.

If the amount of calcium that is added is less than 0.05 wt %, the effect of improving ignition resistance is insignificant. On the other hand, if the amount thereof exceeds 2.0 wt %, the castability of the melt may be deteriorated, die stick ng may increase, and elongation of the alloy may greatly decrease by forming coarse intermetallic compound particles. Moreover, in the extrusion process, the extrusion load may be greatly increased, resulting in.surface cracking, which is undesirable.

Therefore, when the magnesium alloy extrudate according to the present disclosure includes Ca, the amount of Ca preferably falls in the range of 0.05 to 2.0 wt %.

Meanwhile, among the magnesium alloys according to the present disclosure, a magnesium alloy suitable for high-speed. extrusion includes 3.0 to 7.0 wt % of bismuth (Bi), 1.0 to 5.0 wt % of aluminum (Al), the balance of magnesium (Mg) , and inevitable impurities.

For the magnesium alloy for high--speed extrusion according to the present disclosure, an $Mg_3Bi_2$ secondary phase (FIG. 1) having excellent high-temperature stability may be precipitated. during extrusion. Therefore, even when extruded at a high temperature of 300° C. or higher and a very high die-exit speed of 40 m/min or more, an extrudate having a good surface quality without hot cracking may be obtained.

ALso, the addition of aluminum (Al) promotes dynamic recrystallization during extrusion, thus obtaining a microstructure composed of uniform and fine grains, and the effects of grain-boundary strengthening and solid-solution strengthening may be exhibited, greatly improving the mechanical properties (strength, elongation, etc.) of the extrudate.

The magnesium alloy for high-speed extrusion according to the present disclosure may further include 0.1 to 1.0 wt % of any one metal or 0.1 to 1.0 wt % of each of two or more metals selected from the group consisting of calcium (Ca), manganese (Mn), tin (Sn), zinc (Zn), and rare-earth metals (yttrium (Y), neodymium (Nd), samarium (Sm) , dysprosium (Dy), holmium (Ho) , erbium (Er), thorium (Th), etc.), as necessary, in addition to Bi and Al, in order to improve the mechanical properties and/or corrosion resistance of the extrudate.

In addition, a method. of manufacturing an extrudate using the magnesium alloy having improved mechanical properties according to the present disclosure described above includes (a) manufacturing a magnesium alloy billet by casting a melt of a magnesium alloy including 2.0 to 8.0 wt % of bismuth (Bi), 0.5 to 6.5 wt % of aluminum (Al), the balance of magnesium (Mg), and inevitable impurities, (b) subjecting the magnesium alloy billet manufactured in step (a) to homogenization heat treatment and cooling, and (c) extruding the magnesium alloy billet subjected to homogenization heat treatment in step (b).

In step (a), a billet may be manufactured by pouring the molten metal including 2.0 to 8.0 wt % of bismuth (Bi), 0.5 to 6.5 wt % of aluminum (Al), the balance of magnesium (Mg), and inevitable impurities into a preheated metal mold.

The casting process in this step is preferably performed in a manner in which the magnesium alloy eat is maintained at 670 to 770° C. for 20 minutes and then cast. If the magnesium alloy melt is cast at a temperature lower than 670° C., casting is difficult due to the low fluidity of the magnesium alloy melt. On the other hand, if the magnesium alloy melt is cast at a temperature higher than 770° C., the magnesium alloy melt may be rapidly oxidized and impurities may be introduced during casting, so the purity of the resulting magnesium alloy billet may be lowered, which is undesirable.

Moreover, the magnesium alloy melt may be manufactured by melting the raw materials of the magnesium alloy, and the method of manufaturing the magnesium alloy melt is not limited thereto, so long as it is a method commonly used in the art, and for example, gravity casting, continuous casting, sand casting, or pressure casting may be used.

Next, step (b) is subjecting the manufactured magnesium alloy billet to homogenization heat treatment and then cooling, and the homogenization treatment is capable of increasing microstructural homogeneity and of forming eguiaxed grain structure, thereby improving the high-temperature workability and mechanical properties of the magnesium alloy.

The range of the homogenization treatment temperature may be appropriately selected depending on the type of alloying element of the magnesium alloy billet by those skilled in the art. The homogenization heat treatment of the magnesium alloy billet is preferably performed at 350 to 550° C. for 0.5 to 72 hours. If the homogenization treatment temperature is lower than 350° C., the homogenization of segregation of alloying elements and the solid solution of the secondary phase to the matrix may insufficiently occur owing to the low temperature. On the other hand, if the homogenization treatment temperature is higher than 550° C., the mechanical properties may be deteriorated due to the occurrence of local melting in the magnesium alloy billet.

Also, if the homogenization treatment time is less than 0.5 hours, the diffusion of alloying elements of the magnesium alloy billet may insufficiently occur and thus the homogenization treatment effect may not be apparent. On the other hand, if the homogenization treatment time exceeds 72 hours, the increase in the homogenization effect may not be great in consideration of the increased processing time, thus negating economic benefits.

Also, in order to make the microstructure of the magnesium alloy billet into a super-saturated solid-solution state through homogenization treatment, it is preferable to configure the magnesium alloy billet to rapidly cool through water quenching or the like.

Finally, in step (c), the magnesium alloy billet subjected to homogenization heat treatment is extruded and processed into an extrudate.

For example, a magnesium alloy extrudate may be manufactured by directly extruding or indirectly extruding the magnesium alloy. In the extrusion process, in order to form finer grains, the magnesium alloy billet subjected to homogenization heat treatment is preferably preheated to a temperature of 200 to 450° C. for 0.5 to 2 hours before extrusion.

The specific method for per the extrusion process in this step is not. particularly limited, and for example, an indirect extrusion process, a direct extrusion process, a hydrostatic extrusion. process, or an impact extrusion process may be performed.

Also, the shape of the extrudate manufactured through this step is not particularly limited, and examples thereof may include various shapes, such as a rod, a pipe, an angle, a plate, and others.

Figure 2:
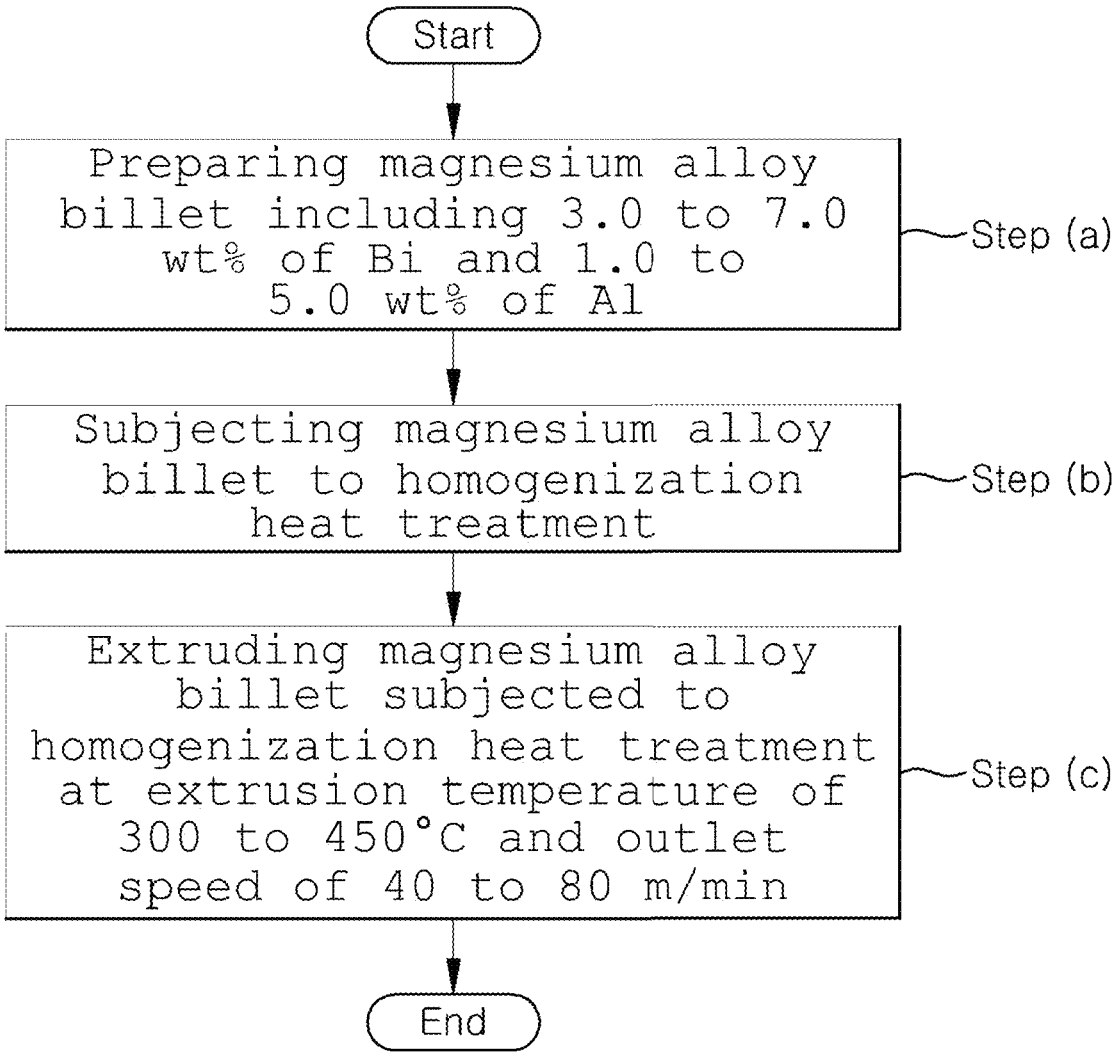
FIG. 2 is a flowchart showing steps of the high-speed extrusion process for manufacturing an extrudate using a magnesium alloy for high-speed extrusion according to the present disclosure.

Meanwhile, a method of manufacturing a magnesium alloy extrudate through a high-speed extrusion process from the magnesium alloy for high-speed extrusion according to the present A isclosure described above includes (a) preparing a magnesium alloy billet including 3.0 to 7.0 wt % of bismuth (Bi), 1.0 to 5.0 wt % aluminum (Al), the balance of magnesium (Mg) , and inevitable impurities, (b) subjecting the magnesium alloy billet to homogenization heat treatment, and (c) extruding the magnesium alloy billet subjected. to homogenization. heat treatment under conditions of an extrusion temperature of 300 to 450° C. and. a die-exit speed of 40 to 80 m/min (FIG. 2).

Preparing the magnesium alloy billet in step (a) may be performed through (i) preparing a melt including magnesium and alloying elements and (ii) pouring the melt in a pre-heated metal mold to form a billet.

Here, step (i) is preparing a melt of a magnesium alloy forming the billet. So long as it is a known method capable of manufacturing a melt, a specific method for performing this step is not particularly limited, and, for example, magnesium (Mg) may be placed in a crucible then heated in the state in which a protective gas ($CO_2$, $SF_6$, $SO_2$, Freon gas, Novec™ 612, or a gas mixture thereof) or flux is added in order to prevent ignition of the magnesium alloy, thus melting magnesium, followed by addition of bismuth (Bi) and aluminum (Al), which are alloying elements, thereby forming a melt.

Here, the melt is preferably composed of 3.0 to 7.0 wt % of bismuth (Bi), 1.0 to 5.0 wt % of aluminum (Al), and the balance of magnesium (Mg) as described above, and more preferably 4.0 to 6.0 wt % of bismuth (Bi), 2.0 to 4.0 wt % of aluminum (Al), and the balance of magnesium (Mg).

Step (ii) is pouring the melt in a metal mold such as a preheated steel mold. This step is completed by pouring the magnesium alloy melt prepared in step (i) into the metal mold preheated to an appropriate temperature in consideration both of sufficient removal of moisture from the metal mold and of avoiding a reduction in economic efficiency due to excessive preheating.

Next, step (b) is performing heat treatment to homogenize the compositional segregation present in the magnesium alloy billet manufactured in the previous step and to dissolve a coarse secondary phase formed during solidification into Mg matrix. By performing this step, it is possible to improve extrudability and to increase the strength of the extrudate through dynamic precipitation of the $Mg_3Bi_2$ secondary phase, having excellent thermal stability, in the subsequent extrusion process.

Figure 3:
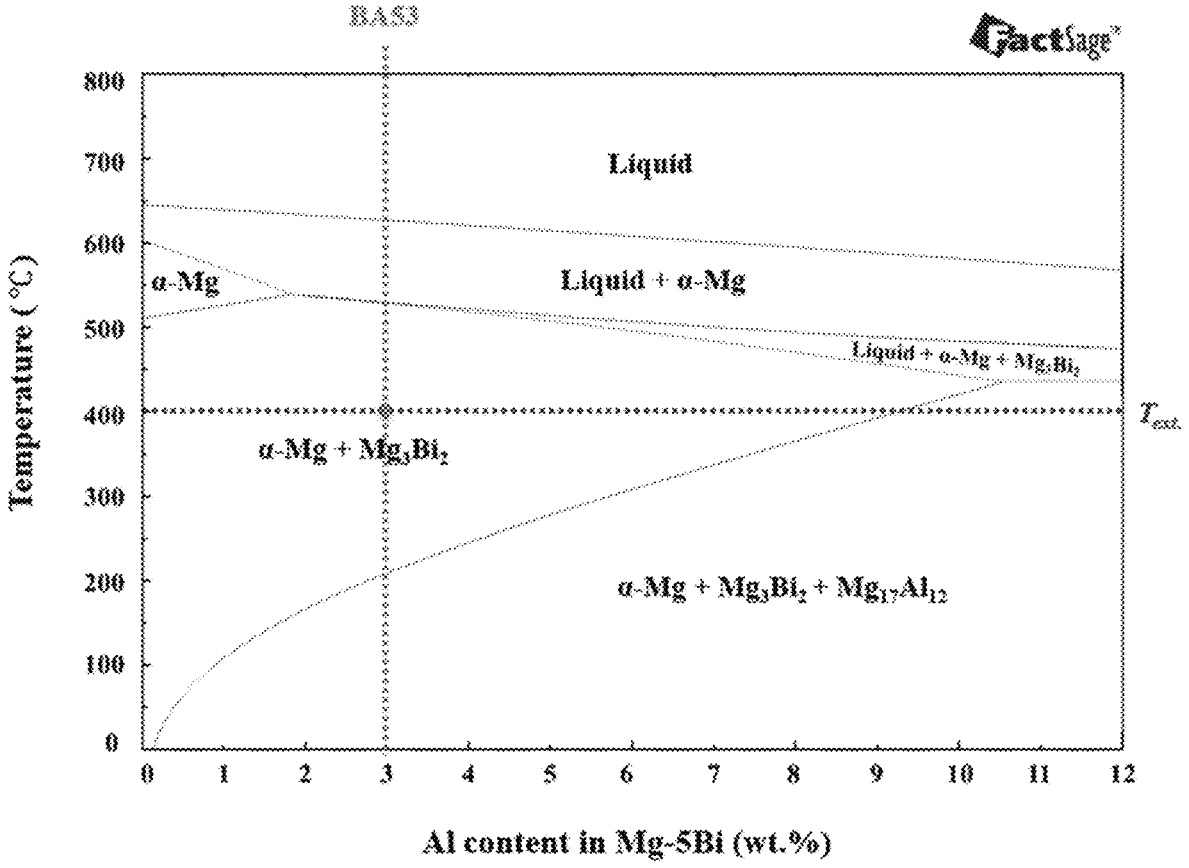
FIG. 3 is an Mg-5Bi-xAl (x=0-12 wt %) ternary equilibrium phase diagram calculated using FactSage software.

In this step, homogenization heat treatment is performed at a temperature corresponding to the two-phase region of $\alpha$-Mg and. $Mg_3Bi_2$ in the Mg—Bi—Al ternary equilibrium phase diagram, so it is desirable to prevent the formation of an $Mg_{17}$ $Al_{12}$ phase, which may melt during high-speed extrusion owing to the low melting point thereof and may thus cause surface cracking of the extrudate (FIG. 3).

After homogenization heat treatment, the magnesium alloy billet is cooled, and the specific method for performing this cooling process is not particularly limited, but in order to prevent static precipitation of Bi- or Al-containing secondary phase during cooling and to prevent the formation of a thermally unstable $Mg_{17}Al_{12}$ phase, water quenching rather than air cooling is preferable.

Subsequently, in step (c), the magnesium alloy billet subjected to homogenisation heat treatment is extruded at a temperature of 300 to 450° C. and a very high die-exit speed of 40 to 80 m/min, thereby obtaining a good magnesium alloy extrudate without surface cracking.

As mentioned above, the Mg—Bi—Al magnesium alloy high thermal stability because an $Mg_3Bi_2$ secondary phase with a high melting point of 823° C. is formed through dynamic precipitation during extrusion. Even when extrusion is performed under conditions of an extrusion temperature of 300 to 450° C. and a die-exit speed of 40 to 80 m/min, the formed $Mg_3Bi_2$ secondary phase is not melted by the processing heat generated during extrusion, thereby preventing hot cracking of the extrudate.

The magnesium alloy according to the present disclosure specified above is configured such that the Mg—Bi binary alloy is further added aluminum (Al), thereby promoting dynamic recrystallization during extrusion, resulting in a microstructure composed of uniform and fine grains. Even though the magnesium. alloy according to the present disclosure does not contain a rare-earth metal as the alloying element, the magnesium alloy extrudate may exhibit greatly improved strength and elongation compared to the existing magnesium extrudate.

In addition, when manufacturing an extrudate using the magnesium alloy for high-speed extrusion according t the present disclosure, it is possible to produce a magnesium alloy extrudate having a good surface quality without of cracking even under high-temperature (extrusion temperature: 300 to 450° C.) and high-speed (die-exit speed: 40 to 80 m/min) extrusion conditions. Therefore, the extrudate may be manufactured at a speed at least 10 times as fast as highly alloyed commercial magnesium alloys such as AS80 (Mg-8Al-0.5Zn), AZ91 (Mg-9Al-1Zn), ZK60 (Mg-6Zn-0.5Zr), and the like, and thus the present disclosure may be very efficiently used for mass production of the magnesium alloy extrudate by greatly reducing manufacturing costs by virtue of the improved productivity.

A better understanding of the present disclosure may be obtained through the following examples.

The embodiments according to the present specification may be modified in various forms, and the scope of the present specification is not to be construed as being limited to the embodiments described below. The embodiments of the present specification are provided to more completely describe the present specification to those of ordinary skill in the art.

Example 1

Manufacture of Mg—Bi-Based Magnesia Alloy and Analysis and Evaluation of Properties Thereof In order to manufacture a. magnesium alloy extrudate according to the present disclosure, the magnesium alloy cast billets of Examples 1-1 to 1-10 having the alloy compositions shown in Table 1 below were manufactured as follows.

In the process of manufacturing the billet for extrusion, a pure Mg ingot having a purity of 99.99% was melted in a carbon crucible in a mixed gas atmosphere of $CO_2$ and $SF_6$, added with bismuth and aluminum, maintained at 720° C. for 20 minutes for stabilization, sufficiently stirred so that the melt was made uniform, and then poured into a steel mold preheated to 210° C. The chemical composition of the cast alloy was measured using an inductively coupled. plasma spectrometer (PerkinElmer, Optima 7300DV).

Next, the cast billet was subjected to homogenization heat treatment in an inert gas atmosphere using an electric furnace at 410° C. for 24 hours, and then to water quenching in order to prevent static precipitation of Bi and Al dissolved in the magnesium matrix during cooling.

The billet subjected to homogenization heat treatment was machined into a cylindrical sample with a diameter of 68 mm and a length of 120 mm, preheated at 350° C. for 1 hour, and then directly extruded at 350° C. and a ram speed of 1 mm/s with an extrusion ratio of 10, thereby manufacturing an extruded bar having a diameter of 21.5 mm.

TABLE 1

| | Alloy | Alloy composition (wt %) | | | Tensile properties | | | |
|---|---|---|---|---|---|---|---|---|
| | | | | | Yield Strength | Tensile Strength | Elongation | Tensile Strength* Elongation |
| | Alloy | Bi | Al | Mg | (MPa) | (MPa) | (%) | (MPa · %) |
| Example 1-1 | BA31 | 3 | 1 | Bal. | 175 | 237 | 9.4 | 2228 |
| Example 1-2 | BA32 | 3 | 2 | Bal. | 173 | 242 | 16.9 | 4090 |
| Example 1-3 | BA51 | 5 | 1 | Bal. | 167 | 235 | 10.4 | 2444 |
| Example 1-4 | BA52 | 5 | 2 | Bal. | 159 | 236 | 17.0 | 4012 |
| Example 1-5 | BA53 | 5 | 3 | Bal. | 163 | 258 | 19.1 | 4928 |
| Example 1-6 | BA54 | 5 | 4 | Bal. | 153 | 254 | 20.8 | 5283 |
| Example 1-7 | BA55 | 5 | 5 | Bal. | 172 | 274 | 19.2 | 5261 |
| Example 1-8 | BA56 | 5 | 6 | Bal. | 179 | 294 | 19.7 | 5792 |
| Example 1-9 | BA71 | 7 | 1 | Bal. | 177 | 244 | 13.0 | 3172 |
| Example 1-10 | BA72 | 7 | 2 | Bal | 169 | 249 | 20.1 | 5005 |

In addition, the magnesium alloy extrudates of Comparative Examples 1-1 to 1-5 were manufactured according to the same process as in Examples 1-1 to 1-10, with the exception that the alloy compositions were as shown in Table 2 below.

TABLE 2

| | Alloy | Alloy composition (wt %) | | | Tensile properties | | | |
|---|---|---|---|---|---|---|---|---|
| | | | | | Yield Strength | Tensile Strength | Elongation | Tensile Strength* Elongation |
| | Alloy | Bi | Al | Mg | (MPa) | (MPa) | (%) | (MPa · %) |
| C. Example 1-1 | B3 | 3 | — | Bal. | 152 | 209 | 2.8 | 585 |
| C. Example 1-2 | B5 | 5 | — | Bal. | 139 | 197 | 2.9 | 571 |
| C. Example 1-3 | B6 | 6 | — | Bal. | 129 | 196 | 4.0 | 784 |
| C. Example 1-4 | B7 | 7 | — | Bal. | 124 | 193 | 6.2 | 1197 |
| C. Example 1-5 | B9 | 9 | — | Bal. | 141 | 203 | 5.0 | 1015 |

The microstructural characteristics of the extrudates were analyzed using an FE-SEM equip ed. with an electron backscatter diffraction (EBSD) detector.

In order to quantitatively analyze the variation in the dynamic recrystallization (DRX) fraction with the amount of added aluminum (Al) ,the area fraction of unrecrystallized grains in the surface region, the quarter region, and the center region of the longitudinal cross--section of the extrudate was measured over a relatively large are of 18.8 $mm^2$ in the optical micrograph of each region.

The EBSD experiment was performed using TexSEM Laboratories (TSL) data acquisition software under conditions of a step size of 0.9 μm and a confidence index >0.1, in the region of 2.02 $mm^2$ for the longitudinal cross-section of the alloy (B5) manufactured in Comparative Example 1-2, the alloy (BA53) manufactured in Example 1-5, and the alloy (BA56) manufactured in Example 1-8.

Figure 4:
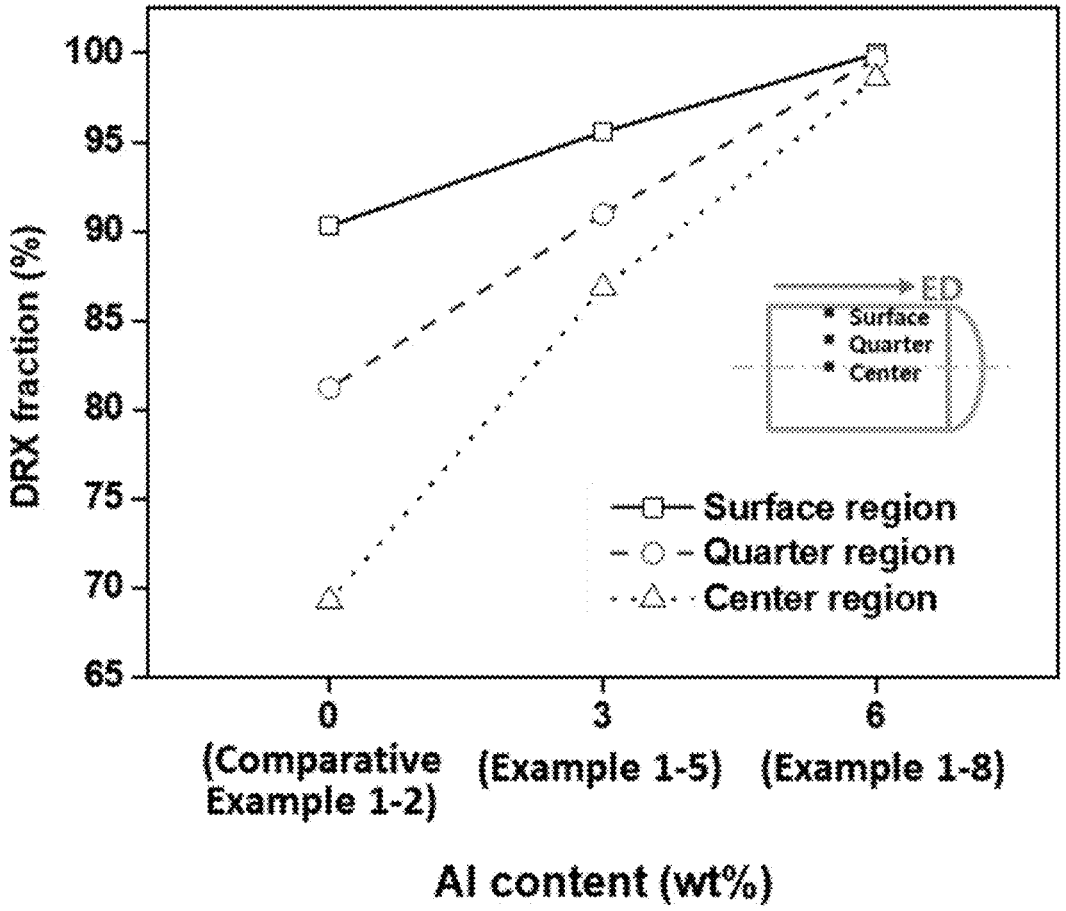
FIG. 4 shows the results of measurement of changes in a dynamic recrystallization (DRX) fraction in the surface region, the quarter region, and the center region of the magnesium alloy extrudate manufactured in each of Comparative Example 1-2, Example 1-5, and Example 1-8.

FIG. 4 shows the dynamic recrystallization (DRX) fraction in the surface region (S), the quarter region (Q) , and the center region (C) of the magnesium alloy extrudate manufactured in each of Comparative Example 1-2, Example 1-5, and Example 1-8, as expressed as a function of the amount of Al.

As the amount of Al increased in all regions, the DRX fraction increased, and the degree of the increase thereof was greater in the center region (69.3 to 100%) than in the surface region (90.3 to 100%).

In general, since the surface region undergoes more severe metal flow than the center region during extrusion, the effective strain that is applied to the material during extrusion is higher in the surface region than in the center region. Moreover, the deformation temperature is higher at the surface region owing to friction between the billet and the wall of the container. Therefore, the greater effective strain and higher deformation temperature promote PBX during hot extrusion, resulting in a higher DRX fraction of the surface region of the extrudate.

In the extrudate (B5) manufactured in Comparative Example 1-2, the average DRX fraction calculated based on the DRX fraction of each region was relatively low (80.3%), and the difference in the DRX fraction between the surface region and the center region was relatively high (21.0%), indicating that the microstructural non-uniformity of the extrudate was high (FIG. 4). However, when the Mg—Bi binary alloy is added with Al, the DRX fraction increases throughout the extrudate, and the uniformity of the microstructure is also greatly improved. When the amount of Aa increased from 0 wt. % to 6 wt %, the average DRX fraction increased from 80.3% to 99.4%, and the difference in the DRX fraction decreased considerably from 21.0% to 1.4%, indicating that the uniformity of the microstructure of the extrudate was remarkably increased within the corresponding amount range of Al.

Since the alloy (BA56) manufactured in Example 1-8 had an almost completely recrystallized microstructure, there was little change in the microstructure when the amount of Al increased from 6 wt % to 9 wt %.

From the above results, it can be found that the addition of Al to the Mg—Bi binary alloy effectively promotes the DRX behavior during extrusion to thus obtain an. Mg—Bi—Al alloy extrudate having a uniform grain structure.

Figure 5:
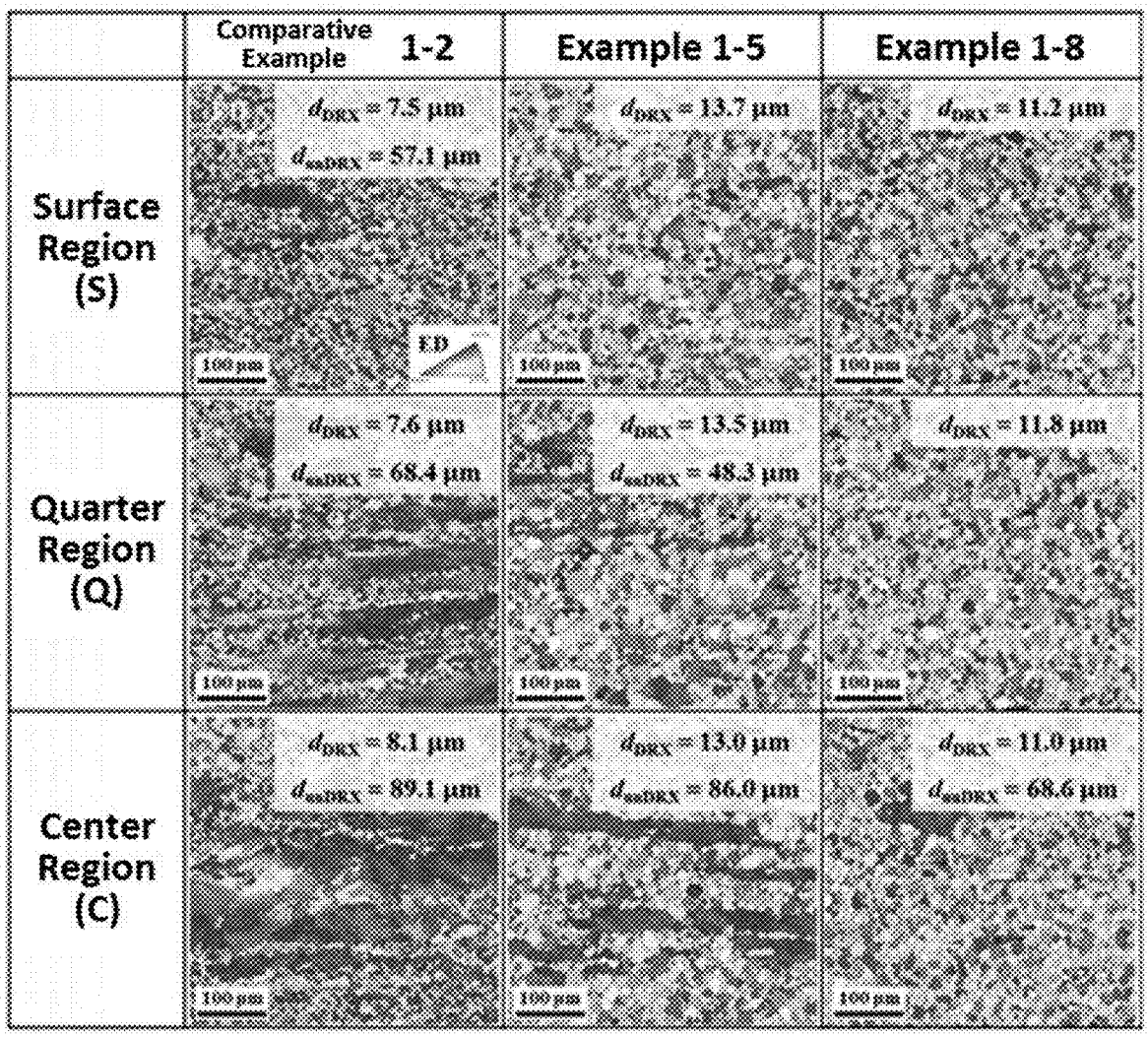
FIG. 5 shows an inverse pole figure map measured using an electron backscatter diffraction detector in the surface region (S), the quarter region (Q) and the center region (C) of the magnesium alloy extrudate manufactured in each of Comparative Example 1-2, Example 1-5, and Example 1-8 ($d_{DRX}$: average size of recrystallized grains, $d_{unDRX}$: average size of unrecrystallized grains).

The effect of the addition of Al on the grain size in the microstructure of the extrudate was analyzed using the inverse pole figure map of the surface region (S), the quarter region (Q) and the center region (C) of the longitudinal cross-section of the extrudate (FIG. 5).

The average size of dynamically unrecrystallized grains (48.3 to 89.1 μm) was much larger than that of dynamically recrystallized grains (4.9 to 13.7 μm), and the effective strain on the surface region was greater, and thus the size of the unrecrystallized grains of the surface region was smaller than that of the unrecrystallized grains of the center region. Furthermore, when the amount of Al increased from 0 wt % to 6 wt %, the size of the unrecrystallized grains in the center region decreased from 89.1 μm to 68.6 μm due to the promotion of DRX.

Also, in Comparative Example 1-2, which is the Mg—Bi binary system, the amount of unrecrystallized grains was considerably large, and. there was a great difference in. the microstructure between the surface region (S) and the center region (C) of the extrudate. On the other hand, in Examples 1-5 and 1-8, which are the Mg—Bi—Al extrudates according to the present disclosure, the amount of unrecrystallized grains was relatively small, and the entire microstructure was uniform. Therefore, when Al was added to the Mg—Bi binary alloy, the average grain size of the extrudate decreased due to the promotion of DRX during extrusion, M and a finer and more uniform. structure could be obtained.

The finer grain size increases the strength of the extrudate by increasing the grain-boundary strengthening effect during tensile deformation, and the reduction. in the area fraction of coarse unrecrystallized grains suppresses the formation of microcracks during tensile deformation, thereby improving the ductility of the extrudate.

Figure 6:
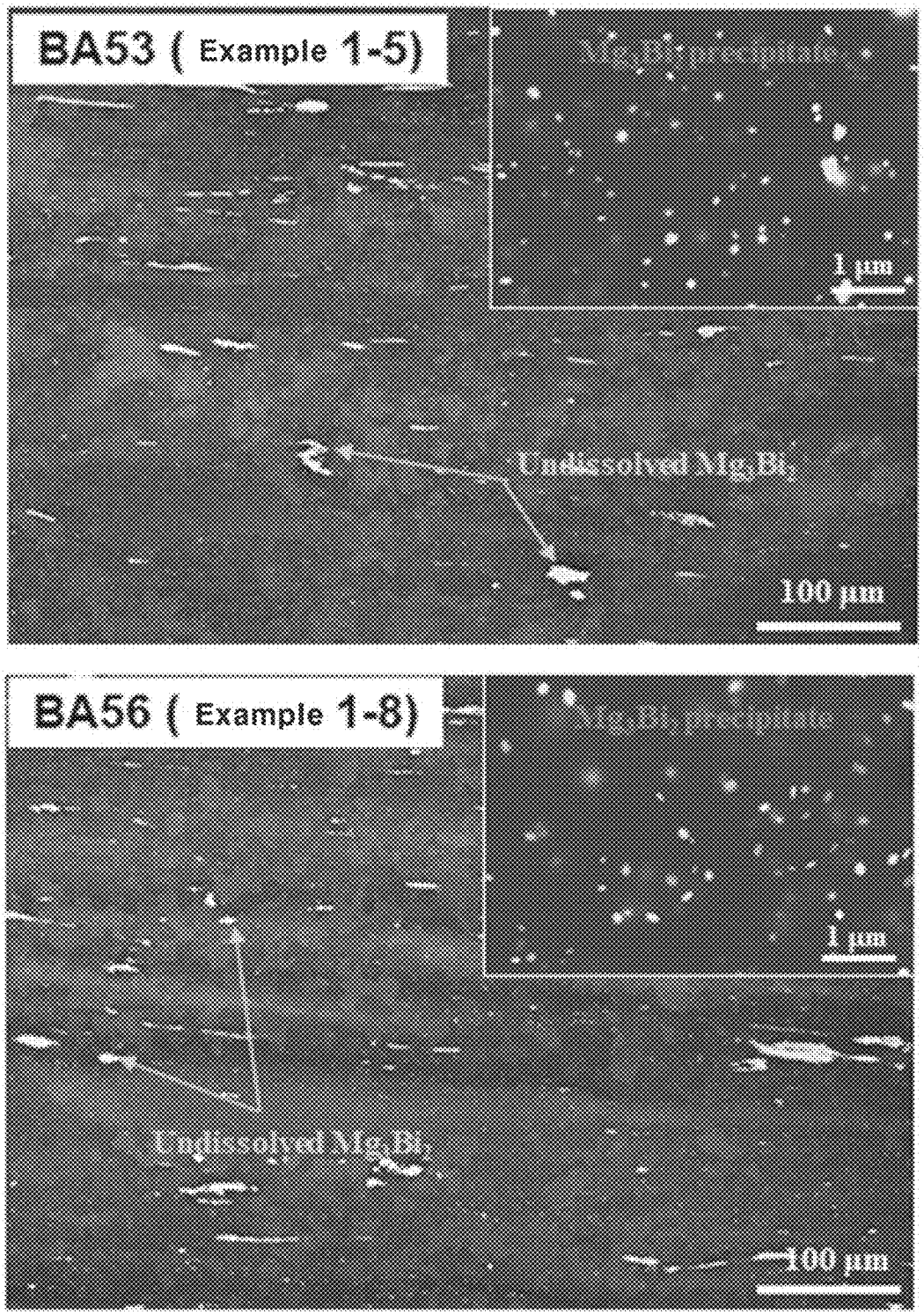
FIG. 6 shows a scanning electron microscope (SEM) image of the center region (C) of the magnesium alloy extrudate manufactured in each of Example 1-5 and Example 1-8.

FIG. 6 shows images at the center region of the extrudate of the alloy (BA53) manufactured in Example 1-5 and the alloy (BA56) manufactured in Example 1-8. A small amount of undissolved $Mg_3Bi_2$ particles rearranged in the extrusion direction (ED) was observed in each of the two extrudates. Moreover, as a dynamic precipitate formed during extrusion, very fine and uniformly distributed $Mg_3Bi_2$ precipitates having a size of 100 nm to 200 nm were present in each of the two extrudates, and their size and number were confirmed to be similar regardless of the amount of Al. The fine precipitates uniformly formed throughout the material effectively interfere with the movement of dislocations during tensile deformation, thus causing a precipitation strengthening effect, thereby increasing the strength of the extrudate.

Figure 7:
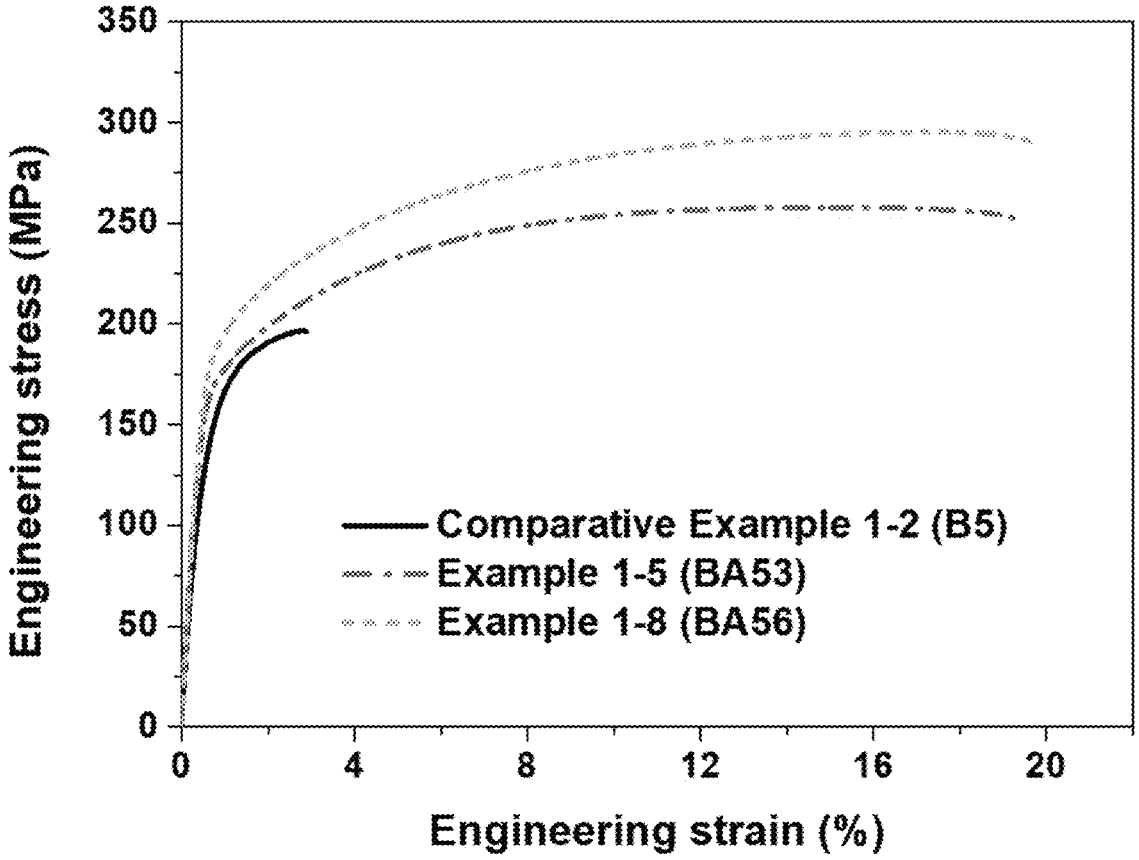
FIG. 7 is a. tensile stress -strain. graph of the magnesium. alloy extrudate manufactured in each of Comparative Example 1-2, Example 1-5, and Example 1-8, respectively.

In order to analyze the mechanical properties of the magnesium alloy extrunate, a tensile test sample having a gauge diameter of 6 mm and a gauge length of 25 mm, obtained. by machining from the magnesium alloy extrudate, was subleted to tensile testing at a strain rate of $1\times10^{-3}$ $s^{-1}$ at room temperature using an Instron 8516 testing machine, and. the results thereof are shown in Tables 1 and 2 and in FIG. 7.

As is apparent from the results of measurement of mechanical properties shown in Tables 1 and 2, the tensile strength * elongation value of the Mg—Bi binary extrudates of Comparative Examples 1-1 to 1-5 was 1197 MPa or less, whereas the Mg—Bi—Al ternary extrudates of Examples 1-1 to 1-10 had considerably higher tensile strength * elongation value of 2228 MPa or more.

In particular, the Mg—Bi—Al ternary extrudates of Examples 1-2, 1-4 to 1-8, and 1-10 including 2 wt % or more of Al exhibited tensile strength * elongation value of 4000 MPa·% or more.

Example 2

Manufacture of Mg—Bi-Based Magnesium Alloy and Evaluation of High-Speed Extrudability First, a magnesium alloy cast billet having the alloy composition of Example 2-1 shown in Table 3 below was manufactured as follows. A pure Mg ingot having a purity of 99.99% was melted in a carbon crucible in a mixed gas atmosphere of $CO_2$ and $SF_6$ and then added with alloying elements hi and Al, alter which the resulting melt was maintained at 720° C. for 20 minutes for stabilization and then poured into a steel mold preheated to 210° C., thereby manufacturing an alloy billet having a chemical composition of Mg-5 wt % Bi-3 wt % Al (BA53).

The cast BA53 alloy billet was subjected to homogenization heat treatment in an. inert gas atmosphere using an. electric furnace at 410° C. for 24 hours and then to water quenching.

The BA53 alloy billet subjected to homogenization heat treatment was machined into a cylindrical sample with a diameter of 68 mm and a length of 120 mm, followed by direct extrusion at an extrusion temperature of 400° C. and a die-exit speed of 60 m/min using a 300 kN horizontal extruder. Before extrusion, the billet was preheated for hour at the corresponding extrusion temperature using a resistance furnace, and was then extruded at a ram speed of 13.1 mm/s and an extrusion ratio of 77:1, thereby obtaining an extruded rod haying a diameter of 7.8 mm.

Also, each extrudate was manufactured in the same manner as in Example 2-1, with the exception. that the magnesium. alloy billet having the alloy composition of each of Examples 2-2 to 2-9 shown in Table 3 below was extruded at a ram speed of 15.1 mm/s and a die-exit speed of 70 m/min.

A magnesium alloy cast billet having the alloy composition of Comparative Example 2-1 shown. in Table 3 below was manufactured as follows. A pure Mg ingot having a purity of 99.99% was melted in a carbon crucible in a mixed gas atmosphere of $CO_2$ and $SF_6$ and then added with alloying elements Al, Zn and Mn, after which the resulting melt was maintained at 720° C. for 20 minutes for stabilization and then poured into a steel mold preheated to 210° C., thereby manufacturing an alloy billet having the chemical composition of Mg—8 wt % Al-0.5 wt % Zn-0.3 wt % Mn (AZ80).

The cast AZ80 alloy billet was subjected to homogenization. heat treatment in an inert gas atmosphere using an electric furnace at 410° C. for 24 hours and then to water quenching.

After homogenization heat treatment, the AZ80 alloy billet was machined into a cylindrical sample with a diameter of 70 mm and a length of 120 mm and then directly extruded at an extrusion temperature of 400° C. and a die-exit speed of 4.5 m/min using a 300 kN horizontal extruder. Before extrusion, the billet was preheated for 1 hour at the corresponding extrusion temperature using a resistance furnace, and was then extruded at a ram speed of 1.5 mm/s and an extrusion ratio of 50:1, thereby obtaining an extruded rod having a diameter of 9.6 mm.

Also, the extrudate of Comparative Example 2-2 was manufactured in the same manner as in Comparative Example 2-1, with the exception that extrusion was performed at a ram speed of 2.0 mm/s and a die-exit speed of 6.0 m/min.

TABLE 3

| | | Alloy composition (wt %) | | | | | | | Extrusion result | |
|---|---|---|---|---|---|---|---|---|---|---|
| | Alloy | Bi | Al | Ca | Mn | Y | Zn | Mg | Extrusion speed (m/min) | Presence or absence of surface defects |
| C. Ex. 2-1 | AZ80 | — | 8 | — | 0.3 | — | 0.5 | Bal. | 4.5 | Cracked |
| C. Ex. 2-2 | AZ80 | — | 8 | — | 0.3 | — | 0.5 | Bal. | 6.0 | Cracked |
| Ex. 2-1 | BA53 | 5 | 3 | — | — | — | | Bal. | 60 | No cracking |
| Ex. 2-2 | BA53 | 5 | 3 | — | — | — | | Bal. | 70 | No cracking |
| Ex. 2-3 | BAX5202 | 5 | 2 | 0.2 | — | — | | Bal. | 70 | No cracking |
| Ex. 2-4 | BAX5204 | 5 | 2 | 0.4 | — | — | | Bal. | 70 | No cracking |
| Ex. 2-5 | BAM5202 | 5 | 2 | — | 0.2 | — | | Bal. | 70 | No cracking |
| Ex. 2-6 | BAM5204 | 5 | 2 | — | 0.4 | — | | Bal. | 70 | No cracking |
| Ex. 2-7 | BAXM520202 | 5 | 2 | 0.2 | 0.2 | — | | Bal. | 70 | No cracking |
| Ex. 2-8 | BAXM520402 | 5 | 2 | 0.4 | 0.2 | — | | Bal. | 70 | No cracking |
| Ex. 2-9 | BAXW530502 | 5 | 3 | 0.5 | — | 0.2 | | Bal. | 70 | No cracking |

Table 3 shows the results of confirming the presence or absence of surface defects of the extrudates manufactured in Examples 2-1 to 2-9 and Comparative Examples 2-1 and 2-2. Also, photographic images of the extrudates manufactured in Examples 2-1 to 2-9 and. Comparative Examples 2-1 and. 2-2 are shown in FIGS. 8 and 9.

Figure 8:
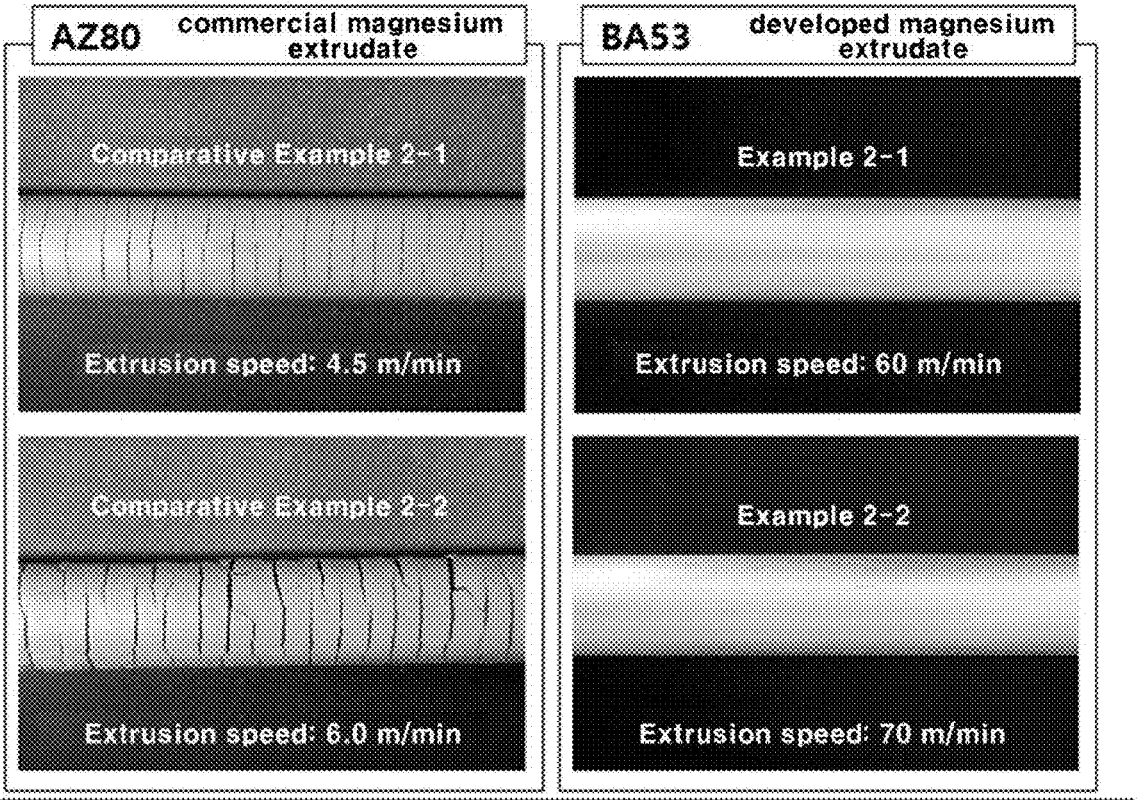
FIG. 8 is a phptograph showing the surface quality of the magnesium extrudate manufactured in each of Example 2-1, Example 2-2, Comparative Example 2-1, and Comparative Example 2-2.
Figure 9:
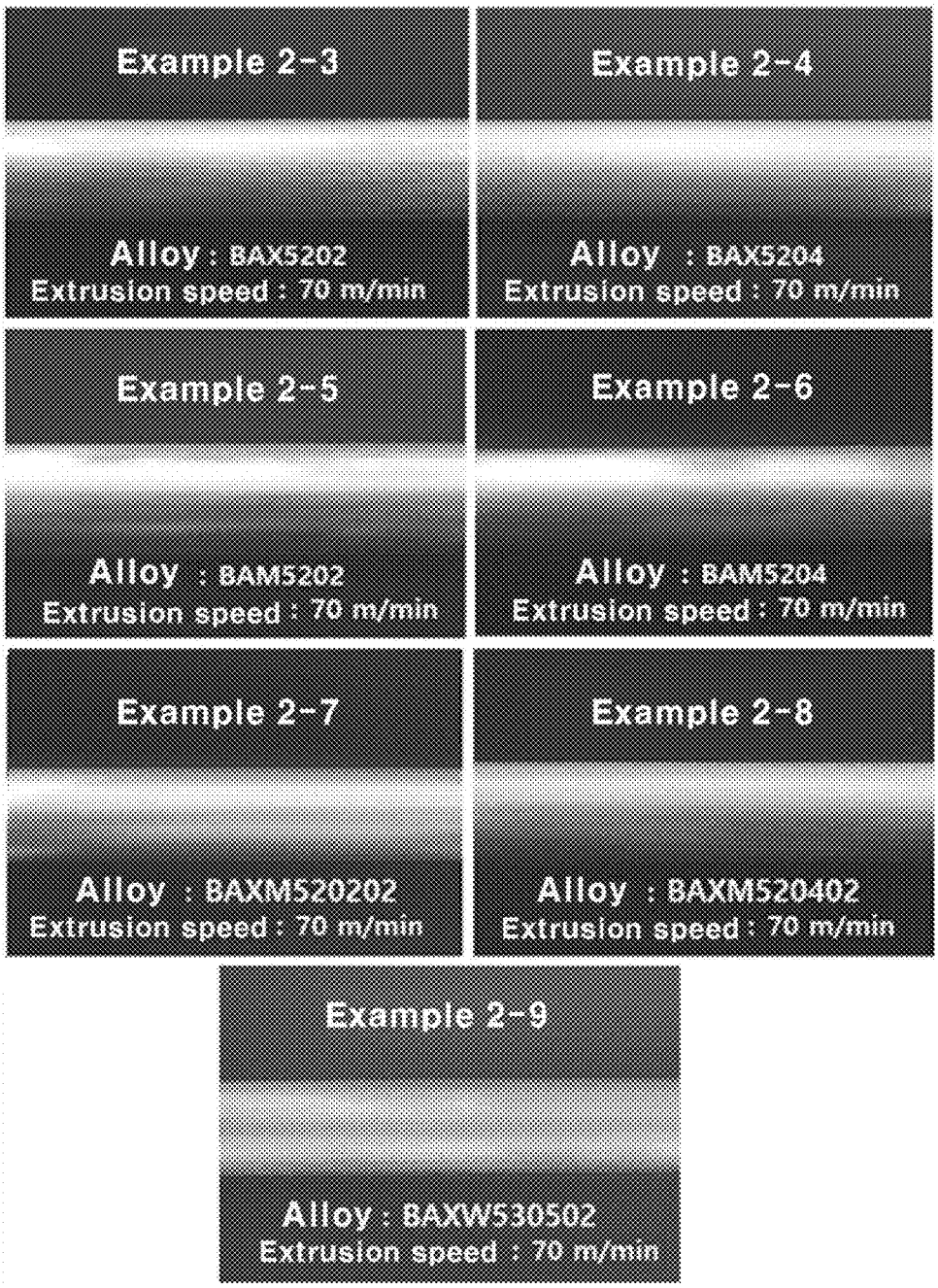
FIG. 9 is a photograph showinc the surface quality of the magnesium extrudate manufactured in each of Example 2-3 to Example 2-9.

According to Table 3 and FIGS. 8 and. 9, each of the extrudates manufactured Comparative Examples 2-1 and 2-2 exhibited severe surface cracking because the deformation temperature near the extrusion die was higher than. the melting point of the secondary phase, $Mg_{17}Al_{12}$, owing to the deformation heat generated during extrusion, despite the extrusion at the die-exit speeds of 4.5 m/min and 6.0 m/min, which is much lower than those of Examples 2-1 to 2-9.

In contrast, the extrudates manufactured in Examples 2-1 to 2-9 exhibited a good surface quality without any defects even upon extrusion at a high temperature of 400° C. and a very high die-exit speed of 60 m/min or 70 m/min.

Although the preferred embodiments of the present disclosure have been. disclosed for illustrative purposes, those skilled in the art will appreciate that various modifications, additions and. substitutions are possible without departing-from the scope and spirit of the disclosure as disclosed in the accompanying claims. Thus, the embodiments described above should be understood to be non-limiting and illustrative in every way.

What is claimed is:

1. A magnesium alloy, comprising:

5.0 wt % of bismuth (Bi);

6.0 wt % to 6.5 wt % aluminum (Al);

a balance of magnesium (Mg); and inevitable impurities, wherein a value of ultimate tensile strength (UTS)×tensile elongation of the magnesium alloy is 5792 MPa ·%.

2. The magnesium alloy of claim 1, wherein a rare-earth metal is not contained as an alloying element.

3. The magnesium alloy of claim 1, wherein high-speed extrusion is possible, the high-speed extrusion comprising a die-exit speed of 40 m/min or more.

4. The magnesium alloy of claim 1, further comprising 0.1 wt % to 1.0 wt % of at least one metal selected from the group consisting of calcium (Ca), manganese (Mn), and yttrium (Y).

5. A method of manufacturing a magnesium alloy extrudate, comprising:

manufacturing a magnesium alloy billet by casting a melt of a magnesium alloy comprising 5.0 wt % of bismuth (Bi), 6.0 to 6.5 wt % of aluminum (Al), a balance of magnesium (Mg), and inevitable impurities;

subjecting the manufactured magnesium alloy billet to homogenization heat treatment and cooling; and extruding the subjected magnesium alloy billet, wherein a value of ultimate tensile strength (UTS)×tensile elongation of the magnesium alloy extrudate is 5792 MPa·%.

6. The method of claim 5, wherein the magnesium alloy billet is subjected to homogenization heat treatment and subsequently water quenching.

7. The method of claim 5, wherein a $Mg_3Bi_2$ secondary phase is dynamically precipitated during the extruding.

8. The method of claim 5, wherein the magnesium alloy billet is extruded using an indirect extrusion process, a direct extrusion process, a hydrostatic extrusion process, or an impact extrusion process.

9. The method of claim 5, wherein the extruding is performed at an extrusion temperature of 300° C. to 450° C. and a die-exit speed of 40 m/min to 80 m/min.

10. The method of claim 9, wherein the magnesium alloy billet is subjected to homogenization heat treatment at a temperature corresponding to a two-phase region of α-Mg and $Mg_3Bi_2$ in an Mg—Bi—Al ternary equilibrium phase diagram.

11. A magnesium alloy extrudate manufactured using the method of claim 5.

12. The magnesium alloy extrudate of claim 11, further comprising $Mg_3Bi_2$ precipitated particles as a secondary phase.

13. The magnesium alloy extrudate of claim 11, wherein the aluminum (Al) is included in an amount of 6.0 wt %.

* * * * *